US011766370B2

(12) United States Patent
Stenson

(10) Patent No.: US 11,766,370 B2
(45) Date of Patent: Sep. 26, 2023

(54) WHEELCHAIR ACCESSORY DEVICE FOR INCREASED MOBILITY

(71) Applicant: Tom Stenson, Enderlin, ND (US)

(72) Inventor: Tom Stenson, Enderlin, ND (US)

( * ) Notice: Subject to any disclaimer, the term of this patent is extended or adjusted under 35 U.S.C. 154(b) by 258 days.

(21) Appl. No.: 17/191,946

(22) Filed: Mar. 4, 2021

(65) Prior Publication Data

US 2022/0280361 A1 Sep. 8, 2022

(51) Int. Cl.
*A61G 5/02* (2006.01)
*A61G 5/10* (2006.01)

(52) U.S. Cl.
CPC ..... *A61G 5/026* (2013.01); *A61G 5/023* (2013.01); *A61G 5/1078* (2016.11)

(58) Field of Classification Search
CPC ..... A61G 5/023; A61G 5/1078; A61G 5/026; A61G 5/027; A62G 5/026; A62G 5/1078; A62G 5/023
USPC ..... 280/259
See application file for complete search history.

(56) References Cited

U.S. PATENT DOCUMENTS 4,483,548 A * 11/1984 Zirrilo ..... A61G 5/1051 403/102
4,720,117 A * 1/1988 Hay ..... A61G 5/023 280/250
4,824,132 A * 4/1989 Moore ..... A61G 5/10 280/250.1
5,273,304 A * 12/1993 Berkheimer ..... A61G 5/026 280/233
5,280,937 A * 1/1994 Needham ..... A61G 5/1051 280/270
5,501,480 A * 3/1996 Ordelman ..... A61G 5/026 280/250
5,899,476 A * 5/1999 Noyola ..... B62M 1/14 280/250.1
6,173,986 B1 * 1/2001 Sicher ..... A61G 5/08 280/647
7,192,043 B1 * 3/2007 McLuen ..... A61G 5/1051 280/62
7,694,991 B2 * 4/2010 Mills ..... A61G 5/10 180/11
D626,038 S * 10/2010 Li ..... D12/112
8,684,113 B1 * 4/2014 Laconis ..... A61G 5/047 180/11

(Continued)

FOREIGN PATENT DOCUMENTS

CA 2560039 A1 * 3/2008 ..... A61G 5/02
DE 19850362 A1 * 10/1999 ..... A61G 5/023

(Continued)

OTHER PUBLICATIONS berkelbike.com [online], "EasyLegs Connect", available on or before May 26, 2015 via Internet Archive: Wayback Machine URL<https://web.archive.org/web/20150526054319/https://berkelbike.com/product/easylegs-connect/>, retrieved on Jan. 27, 2022, retrieved from URL=https://berkelbike.com/product/easylegs-connect/>, 7 pages.

(Continued)

*Primary Examiner* — Tony H Winner
(74) *Attorney, Agent, or Firm* — Fish & Richardson P.C.

(57) ABSTRACT

This document describes accessory devices for wheelchairs. For example, this document describes wheelchair accessory devices that include a wheel and foot pedals so that a wheelchair user can use his/her legs to propel the wheelchair by pedaling.

12 Claims, 3 Drawing Sheets

(56) References Cited

U.S. PATENT DOCUMENTS

| | | | | |
|---|---|---|---|---|
| 9,050,227 | B1 * | 6/2015 | Hargroder | A61G 5/125 |
| 9,067,632 | B2 * | 6/2015 | Mroz | B62M 1/16 |
| 9,067,642 | B2 * | 6/2015 | Bovi | B62M 1/36 |
| 9,241,852 | B2 * | 1/2016 | Dougherty | A61G 5/06 |
| 9,688,346 | B2 * | 6/2017 | Bock | B62K 25/06 |
| 9,700,469 | B2 * | 7/2017 | Golden, Jr. | A61G 5/1083 |
| 10,485,718 | B2 * | 11/2019 | Provda | A61G 5/027 |
| 10,758,434 | B1 * | 9/2020 | Golden, Jr. | A61G 5/027 |
| 2002/0030343 | A1 * | 3/2002 | Schaffner | A61G 5/1078 280/250.1 |
| 2004/0108147 | A1 * | 6/2004 | Ross | B62K 3/16 180/13 |
| 2006/0091663 | A1 * | 5/2006 | Jackson | B60Q 1/0491 280/755 |
| 2006/0267309 | A1 * | 11/2006 | Markovic | A61G 5/023 280/250.1 |
| 2007/0114750 | A1 * | 5/2007 | Dix | A63B 21/158 280/250.1 |
| 2008/0115982 | A1 * | 5/2008 | Lin | A61G 5/047 180/13 |
| 2008/0246251 | A1 * | 10/2008 | Fast | A61G 5/1051 280/304.1 |
| 2010/0109283 | A1 * | 5/2010 | Wilmot | A61G 5/1008 188/2 F |
| 2011/0095508 | A1 * | 4/2011 | Chiu | A61G 5/047 280/304.1 |
| 2015/0217831 | A1 * | 8/2015 | Kohlheb | B62M 1/16 280/240 |
| 2016/0101005 | A1 * | 4/2016 | Golden, Jr. | B62B 19/04 29/401.1 |
| 2017/0172822 | A1 * | 6/2017 | Golden, Jr. | A61G 5/027 |
| 2021/0161739 | A1 * | 6/2021 | Takado | A61G 5/1051 |
| 2022/0117807 | A1 * | 4/2022 | Choi | B60L 50/60 |
| 2022/0370269 | A1 * | 11/2022 | Jones | A61G 5/128 |

FOREIGN PATENT DOCUMENTS

| | | | | |
|---|---|---|---|---|
| EP | 0629390 | A1 * | 12/1994 | |
| ES | 2635621 | A1 * | 10/2017 | |
| FR | 2576782 | A1 * | 8/1986 | |
| GB | 1525225 | A * | 9/1978 | A61G 5/023 |
| GB | 2437502 | A * | 10/2007 | A61G 5/107 |
| GB | 2488141 | A * | 8/2012 | A61G 5/023 |
| KR | 20080049585 | A * | 6/2008 | |

OTHER PUBLICATIONS rehabmart.com [online], "Pedal Wheelchair: Active Mobility for Wheelchair Users", available on or before Jul. 19, 2021 via Internet Archive: Wayback Machine URL<https://web.archive.org/web/2021*/https://www.rehabmart.com/post/pedal-wheelchair-active-mobility-for-wheelchair-users>, retrieved on Jan. 27, 2022, retrieved from URL<https://www.rehabmart.com/post/pedal-wheelchair-active-mobility-for-wheelchair-users> 15 pages.

uniquemedsupply.com [online], "Shield Innovations EZRide+ Wheelchair Power Assist," upon information and belief, available no later than Mar. 4, 2021, retrieved Jan. 27, 2022, retrieved from URL<https://www.uniquemedsupply.com/shield-innovations-ezride-wheelchair-power-assist.html?__store=medical&gclid=EAIaIQobChMImpX-gO7N9QIVLBTUAR2gVAFIEAQYAiABEgIwJvD_BwE>, 4 pages.

* cited by examiner

WHEELCHAIR ACCESSORY DEVICE FOR INCREASED MOBILITY

BACKGROUND

1. Technical Field

This document relates to accessory devices for wheelchairs. For example, this document relates to wheelchair accessory devices that include a wheel and foot pedals so that a wheelchair user can use his/her legs to propel the wheelchair by pedaling.

2. Background Information

Many wheelchair users have a certain extent of leg functionality. In fact, in many cases wheelchair users have more leg strength than arm strength. Accordingly, such a wheelchair user is more able to propel a wheelchair using leg power than arm power. Nevertheless, conventional wheelchairs are solely configured for users to self-propel the wheelchair using arm power.

SUMMARY

This document describes accessory devices for wheelchairs. For example, this document describes wheelchair accessory devices that include a wheel and foot pedals so that a wheelchair user can use his/her legs to propel the wheelchair by pedaling.

In some aspects, this disclosure is directed to a wheelchair accessory device that includes a wheel assembly, a yoke, clamp devices, and a fork assembly. The wheel assembly includes a wheel including a hub, a first crank arm affixed to the hub, a first pedal pivotably attached to the first crank arm, a second crank arm affixed to the hub, and a second pedal pivotably attached to the second crank arm.

The yoke includes a first end portion, a second end portion opposite of the first end portion, and a center portion between the first and second end portions.

The clamp devices include a first clamp device configured to releasably clamp the first end portion of the yoke to a first tube of a wheelchair, and a second clamp device configured to releasably clamp the second end portion of the yoke to a second tube of the wheelchair.

The fork assembly interconnects the yoke and the wheel assembly.

Such a wheelchair accessory device may optionally include one or more of the following optional features. The hub may be rotatably coupled to the fork assembly. In some embodiments, the fork assembly is adjustable in length. The fork assembly may be pivotably coupled to the yoke. In some embodiments, the fork assembly comprises a fork-to-yoke coupling mechanism pivotably coupled to the center portion of the yoke. The fork assembly may also include a handle configured for manually pivoting the fork assembly relative to the yoke. In some embodiments, a ratchet mechanism is provided between the fork-to-yoke coupling mechanism and the center portion of the yoke, and manually pivoting the fork assembly relative to the yoke actuates the ratchet mechanism.

The first clamp device can be used to releasably clamp the first end portion of the yoke to the first tube of the wheelchair at 90-degrees relative to each other. The second clamp device can be used to releasably clamp the second end portion of the yoke to the second tube of the wheelchair at 90-degrees relative to each other.

In some embodiments, the fork assembly includes (i) a first fork leg to which the wheel assembly is rotatably coupled; (ii) a second fork leg to which the wheel assembly is rotatably coupled; (iii) a fork head member with a lower end portion affixed to the first and second fork legs; and (iv) a fork-to-yoke coupling mechanism attached at an upper end portion of the fork head member and pivotably coupled to the center portion of the yoke.

The fork assembly further may include a suspension mechanism including a spring. In such a case, a length of the fork assembly is dependent on an amount of compression of the spring.

In some embodiments, a length of the fork head member is incrementally adjustable.

In particular embodiments, the fork head member is configured to allow the wheel assembly to pivot in relation to the yoke.

In certain example embodiments, the fork assembly includes a releasable latch that: (i) in a first state allows the wheel assembly to pivot in relation to the yoke and (ii) in a second state prevents the wheel assembly from pivoting in relation to the yoke.

Particular embodiments of the subject matter described in this document can be implemented to realize one or more of the following advantages. In some embodiments, the wheelchair accessory devices described herein will provide a wheelchair user with an opportunity for more independent mobility. Many conventional wheelchair users who lack sufficient arm strength are immobile, unless another person is available to push the wheelchair. Since the wheelchair accessory devices described herein allow a wheelchair user to propel themselves using leg power, some wheelchair users will be able to become at least somewhat more independently mobile.

The opportunity to be independently mobile is extremely significant to those who otherwise are dependent on others for mobility. Such independence can greatly enhance a person's dignity and self-worth.

In addition, in some cases the opportunity to be independently mobile can enhance the personal safety of wheelchair users. For example, those wheelchair users who are otherwise dependent on others for their mobility may in some circumstances attempt to walk or crawl to get to a destination (e.g., a bathroom). The enhanced independent mobility provided by the wheelchair accessory devices described herein will reduce the likelihood of such a scenario in which the wheelchair user's safety may be imperiled.

The wheelchair accessory devices described herein can also provide a wheelchair user with the opportunity for much-needed physical exercise. Moreover, the wheelchair accessory devices described herein can be used for physical therapy and rehabilitation regimes in some cases. In such a case, the physical mobility of the exercise can be much more enjoyable for the user than performing similar exercise on a stationary exercise bicycle or other type of exercise device.

The wheelchair accessory devices described herein are advantageously usable with conventional wheelchairs. That is, a conventional wheelchair can be upgraded to include the wheelchair accessory devices described herein. Moreover, the wheelchair accessory devices described herein are deployable and retractable (storable) in relation to the wheelchair. Accordingly, when the wheelchair accessory device is not needed, it can be conveniently pivoted out of the way without detaching it from the wheelchair. Then, when the wheelchair accessory device is needed/desired, it can be conveniently deployed for use.

In addition, the wheelchair accessory devices described herein are mechanically adjustable for proper ergonomic usage by people of different sizes. The adjustability of the wheelchair accessory devices described herein also enables the devices to be used with a wide variety of different types and sizes of wheelchairs.

Unless otherwise defined, all technical and scientific terms used herein have the same meaning as commonly understood by one of ordinary skill in the art to which this invention pertains. Although methods and materials similar or equivalent to those described herein can be used to practice the invention, suitable methods and materials are described herein. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description herein. Other features, objects, and advantages of the invention will be apparent from the description and drawings, and from the claims.

DESCRIPTION OF THE DRAWINGS

FIG. 2A is a perspective view of an example clamp device that can be used to releasably couple the wheelchair accessory device to the conventional wheelchair.

FIG. 2B is an expanded view of a portion of the wheelchair accessory device that includes a length adjustment mechanism in accordance with some embodiments.

Like reference numbers represent corresponding parts throughout.

DETAILED DESCRIPTION

This document describes accessory devices for wheelchairs. For example, this document describes wheelchair accessory devices that include a wheel and foot pedals so that a wheelchair user can use his/her legs to propel the wheelchair by pedaling.

Figure 1:
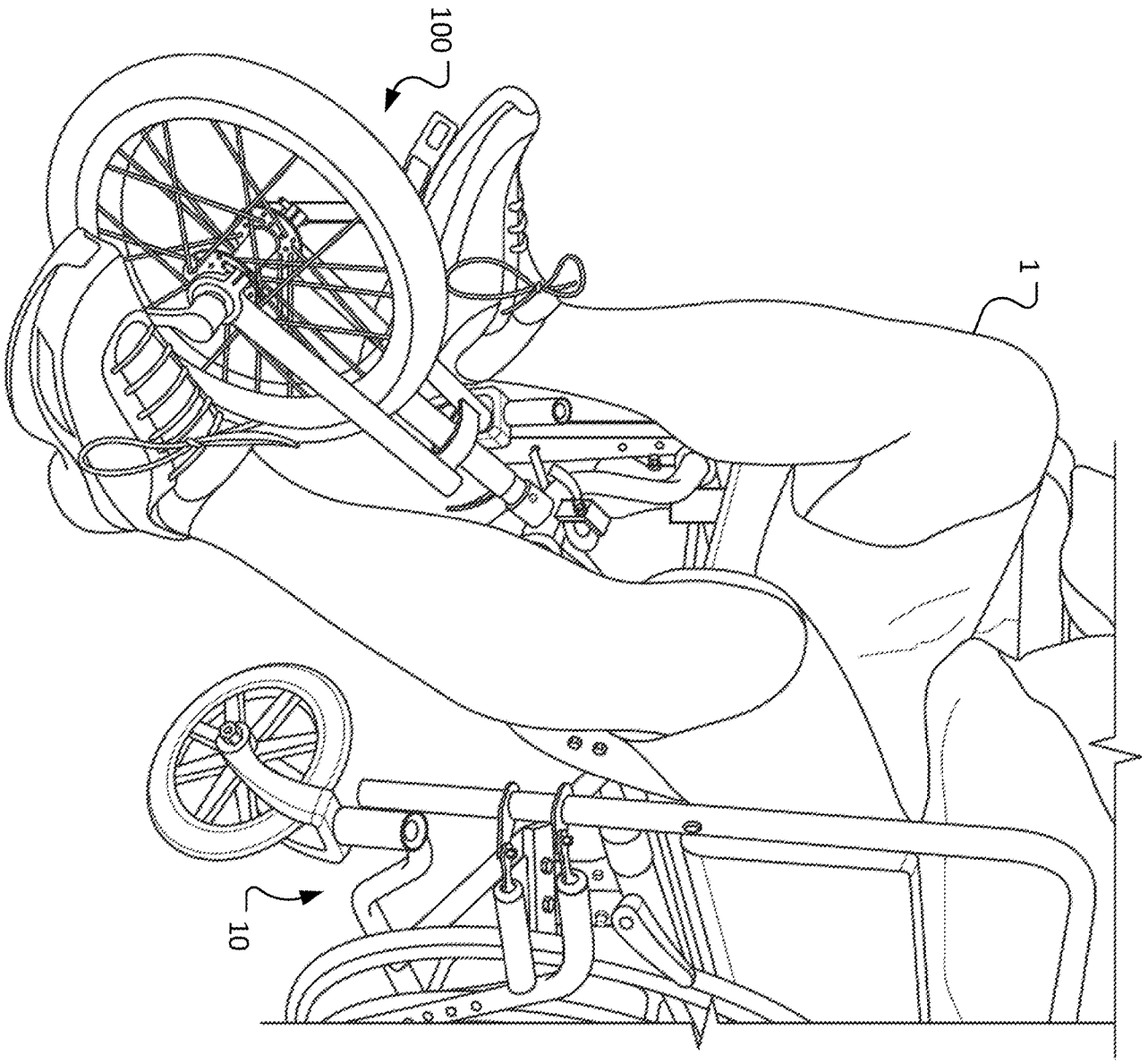
FIG. 1 is a perspective view of a wheelchair user who is pedaling an example wheelchair accessory device that is attached to a conventional wheelchair.

As shown in FIG. 1, a conventional wheelchair 10 can have an attached wheelchair accessory device 100 that allows a wheelchair user 1 to propel themselves using leg power. As described further below, the wheelchair accessory device 100 can be releasably attached to virtually any type and/or size of wheelchair 10.

The wheelchair accessory device 100 is shown here in a deployed, operative arrangement relative to the wheelchair 10. As described further below in reference to FIG. 3, the wheelchair accessory device 100 can be easily pivoted under the seat of the wheelchair 10 to a stowed position in which the wheelchair accessory device 100 is out of the way (while still remaining attached to the wheelchair 10 in a staged arrangement in which it is ready to be deployed). Here in the deployed arrangement, the user 1 can propel themselves by pedaling the wheelchair accessory device 100 like a bicycle or unicycle.

It can be readily envisioned that the user 1 can propel themselves forward or backward (depending on the pedaling direction). In addition, the user 1 can steer themselves in various ways. In a first example, the user 1 can simply restrain one of the wheels of the wheelchair 10 while pedaling the wheelchair accessory device 100. For example, if the user 1 partially or fully restrains the right-side wheel of the wheelchair 10 while pedaling the wheelchair accessory device 100 forward, motion to the right will result. Conversely, if the user 1 partially or fully restrains the left-side wheel of the wheelchair 10 while pedaling the wheelchair accessory device 100 forward, motion to the left will result. Alternatively, or additionally, in some embodiments the wheelchair accessory device 100 itself is steerable, as described further below.

Figure 2:
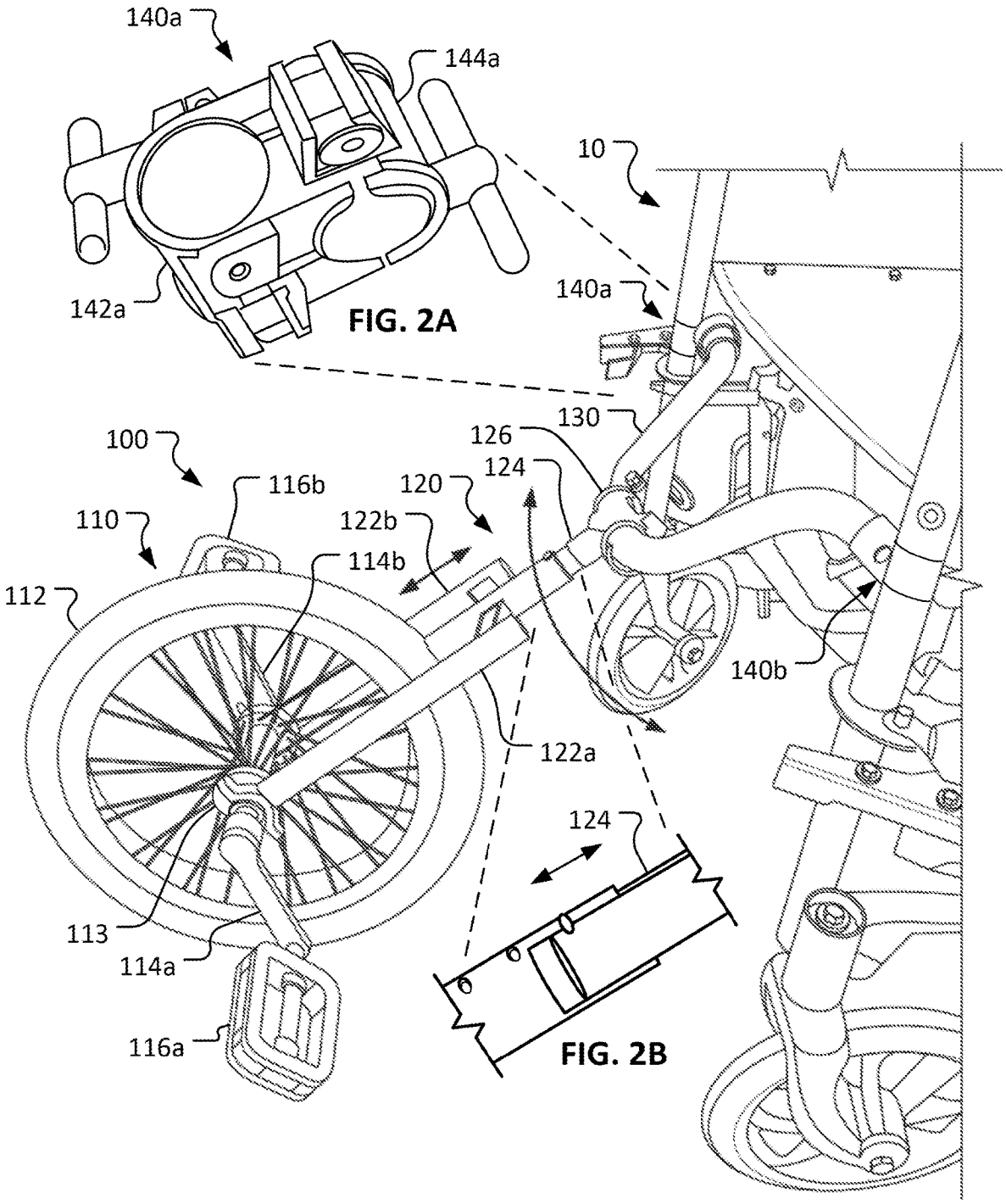
FIG. 2 is a perspective view of the wheelchair accessory device and conventional wheelchair of FIG. 1.

Referring also to FIG. 2, here the user 1 is not shown so that the wheelchair accessory device 100 can be viewed in greater detail. The wheelchair accessory device 100 is shown in its deployed, operable orientation.

Broadly speaking, the wheelchair accessory device 100 includes a wheel assembly 110, a fork assembly 120, a yoke 130, and a clamp system that includes a first clamp device 140*a* and a second clamp device 140*b*. The fork assembly 120 interconnects the wheel assembly 110 to the yoke 130. The first clamp device 140*a* is used to releasably clamp a first end portion of the yoke 130 to a first tube of a wheelchair 10. The second clamp device 140*b* is used to releasably clamp the second end portion of the yoke 130 to a second tube of the wheelchair 10.

The wheel assembly 110 comprises a wheel 112 that includes a hub 113. The wheel assembly 110 also includes a first crank arm 114*a* affixed to the hub 113, and a second crank arm 114*b* affixed to the hub 113. In the depicted embodiment, the first crank arm 114*a* and the second crank arm 114*b* are directly affixed to the hub 113 (without a chain, gears, or any type of mechanical transmission). This arrangement is like that of a typical short unicycle with a direct drive.

In some embodiments, a mechanical transmission can be included by which the first crank arm 114*a* and the second crank arm 114*b* can be used to drive rotations of the wheel 112. For example, in some cases the hub 113 can be a two-speed hub. In some embodiments, the wheel assembly 110 is configured to allow the user 1 to freewheel. That is, in some embodiments the wheel assembly 110 is configured to allow the user 1 to coast or move forward without pedaling, as a common bicycle does. In particular embodiments, a coaster brake mechanism is included.

In some embodiments, the wheel assembly 110 can be configured to include an "exercise mode." In the exercise mode, the user 1 can pedal the pedals 116*a-b* and crank arms 114*a-b* without turn the wheel 112. Accordingly, the user 1 can get leg and cardiovascular exercise by pedaling, while the wheelchair 10 remains in a stationary location. In some such embodiments, a clutch mechanism is included which can be selectively activated and deactivated. For example, the clutch mechanism can be deactivated so that the user 1 can use the wheelchair accessory device 100 in the exercise mode. Then, when the user 1 wants to use the wheelchair accessory device 100 to actually propel themselves around in the wheelchair 10, the user can activate the clutch so that pedaling motion of the pedals 116*a-b* and crank arms 114*a-b* will turn the wheel 112 and thereby cause the wheelchair 10 to be propelled.

In some embodiments, the exercise mode can include a resistance adjustment mechanism. That is, the user 1 can make an adjustment to the wheel assembly 110 to increase or decrease the force required to pedal the pedals 116*a-b* and crank arms 114*a-b* while the wheelchair 10 remains stationary. Accordingly, by increasing the resistance the user 1 can exercise at a greater intensity level. The reverse is also true. That is, by decreasing the resistance the user can exercise as a lower intensity level.

In some embodiments, the wheel 112 can be raised above the floor surface and the resistance adjustment can be an idler wheel that can be pressed against the wheel 112 at adjustable amounts of pressure to increase and decrease the resistance to pedaling the pedals 116*a-b* and crank arms 114*a-b* while the wheelchair 10 remains stationary. In another example, in some embodiments the resistance adjustment can be a caliper brake mechanism (like the type that are used on a bicycle) that acts on the rim of the wheel 112. The user 1 can simply turn a knob to adjust the amount of compression between the friction pads of the caliper brake mechanism to increase and decrease the resistance to pedaling the pedals 116*a-b* and crank arms 114*a-b* while the wheelchair 10 remains stationary.

A first pedal 116*a* is pivotably attached to the first crank arm 114*a*. Similarly, a second pedal 116*b* is pivotably attached to the second crank arm 114*b*. The first pedal 116*a* and the second pedal 116*b* are configured to be pushed and rotated by the feet/footwear of the user 1. In some embodiments, the pedals 116*a-b* can include straps (e.g., adjustable or non-adjustable), clamps, sheaths, latches, and the like, to releasably attach or restrain the feet/footwear of the user 1 to the pedals 116*a-b*.

The yoke 130 has a first end portion, a second end portion opposite of the first end portion, and a center portion between the first and second end portions. The first and second end portions are used to attach the yoke 130 to the wheelchair 10 using the clamp devices 140*a-b*, as described further below. The center portion of the yoke 130 is where the fork assembly 120 attaches to the yoke 130. The yoke 130 has a generally Y-shape, overall.

In some embodiments, the first and second end portions of the yoke 130 are individually length-adjustable. For example, in some embodiments the first and second end portions of the yoke 130 can be telescoped (and locked) to increase or decrease the lengths of the first and second end portions of the yoke 130.

The first clamp device 140*a* and the second clamp device 140*b* are used to releasably clamp the first end portion of the yoke 130 to a first tube of the wheelchair 10 and the second end portion of the yoke 130 to a second tube of the wheelchair 10. As shown in the example of FIG. 2A, in some embodiments the clamp device 140*a* (which can also serve as representative of the clamp device 140*b*) includes a first clamp portion 142*a* and a second clamp portion 144*a*. In some cases, the first clamp portion 142*a* can be used to releasably clamp onto the tube of the wheelchair 10, and the second clamp portion 144*a* can be used to releasably clamp onto the first end portion of the yoke 130. As depicted, in some embodiments the first clamp device 140*a* releasably clamps the first end portion of the yoke 130 to the first tube of the wheelchair 10 at about 90-degrees relative to each other.

The depicted example clamp device 140*a* (which can also serve as representative of the clamp device 140*b*) includes a first hinged split-ring clamp for the first clamp portion 142*a*, and a second hinged split-ring clamp for the second clamp portion 144*a*. Accordingly, the clamp device 140*a* can be conveniently attached to the wheelchair 10, and conveniently detached from the wheelchair 10. In addition, the clamp device 140*a* can be conveniently attached to the first end portion of the yoke 130, and conveniently detached from the first end portion of the yoke 130. Moreover, the positioning of the clamp device 140*a* can be conveniently adjusted rotationally and/or along the length of the tube of the wheelchair 10 to which it is coupled. Similarly, the positioning of the clamp device 140*a* can be conveniently adjusted rotationally and/or along the length of the first end portion of the yoke 130. Accordingly, a great deal of adjustability and adaptability is provided by the hinged split-ring clamps of the clamp devices 140*a-b*. In some embodiments, other types of clamps can be used.

The wheelchair accessory device 100 also includes the fork assembly 120. The fork assembly 120 interconnects the yoke 130 and the wheel assembly 110. The fork assembly 120 is pivotably coupled to the yoke 130. In some embodiments, the fork assembly 120 can include various optional features, alone or in combination, as described further below.

In the depicted embodiment, the fork assembly 120 comprises a first fork leg 122*a* to which the wheel assembly 110 (e.g., the hub 113 or its axle) is rotatably coupled, and a second fork leg 122*b* to which the wheel assembly 110 (e.g., the hub 113 or its axle) is rotatably coupled. In some embodiments, a bearing or bushing is used to rotatably couple the fork legs 122*a-b* to the wheel assembly 110.

The fork assembly 120 also comprises a fork head member 124. A lower end portion of the fork head member 124 is affixed to the first and second fork legs 122*a-b*.

Figure 3:
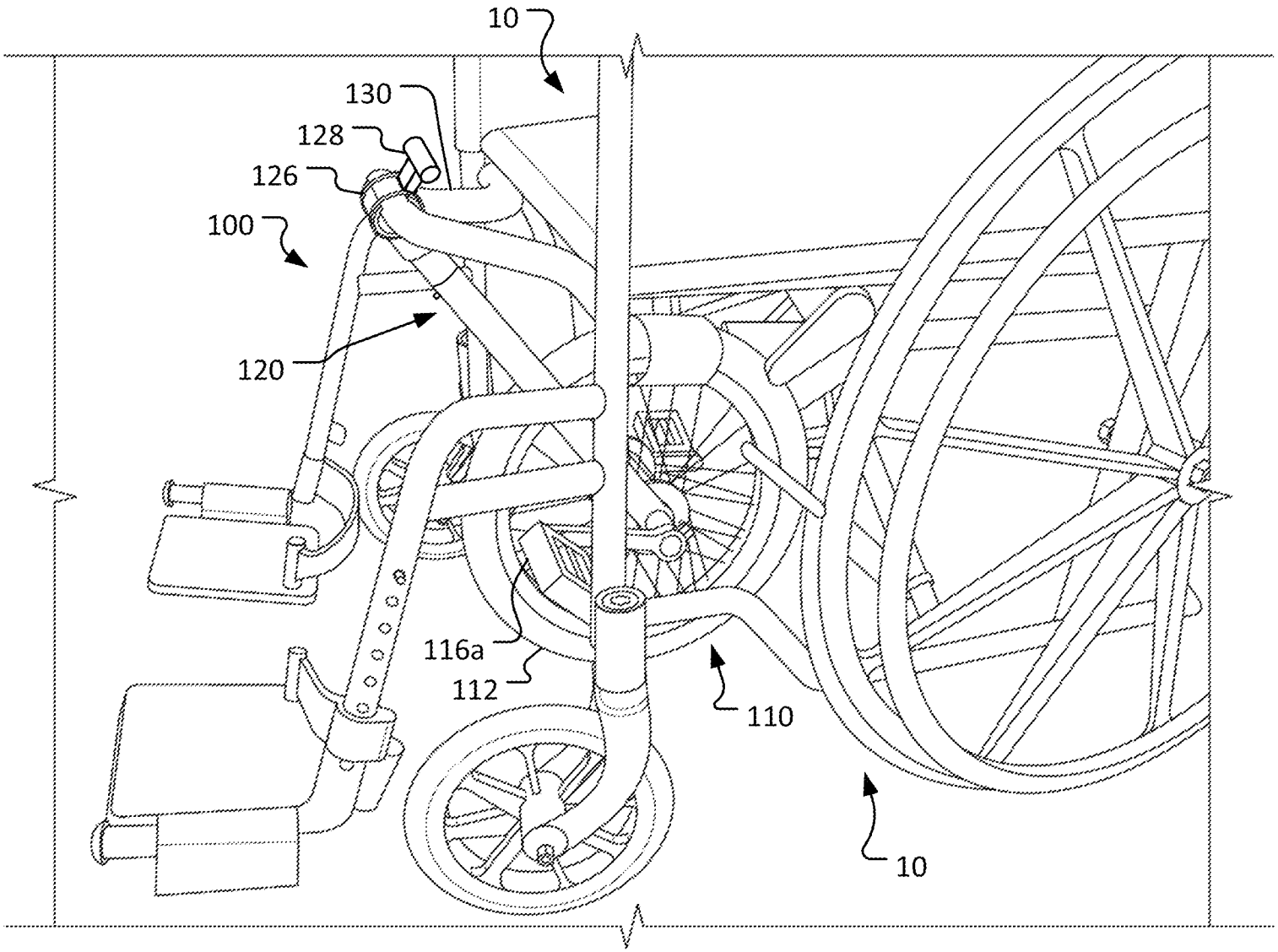
FIG. 3 is another perspective view of the wheelchair accessory device and conventional wheelchair of FIG. 1. In this view, the wheelchair accessory device is in a stowed configuration.

The fork assembly 120 also comprises a fork-to-yoke coupling mechanism 126. The fork-to-yoke coupling mechanism 126 is attached to an upper end portion of the fork head member 124. The fork-to-yoke coupling mechanism 126 is pivotably coupled to the center portion of the yoke 130. Accordingly, as described further below, the fork-to-yoke coupling mechanism 126 configures the fork assembly 120 to allow the wheel assembly 110 to pivot in relation to the yoke 130 and the wheelchair 10 between a deployed operative configuration (as shown in FIGS. 1 and 2) and a retracted stowed configuration (as shown in FIG. 3).

Referring also to FIG. 2B, in some embodiments the fork head member 124 is adjustable in length. For example, in some embodiments the fork head member 124 is telescopic. In the depicted embodiment, the length of the fork head member 124 is incrementally adjustable by virtue of a spring-loaded pin that can be selectively positioned in any hole of a series of holes. Of course, it is also envisioned that other types of telescopic length adjustment/locking mechanisms can be used (e.g., flip lock clamp collars, twist lock rings, compression ring clamps. dowel pins in holes, collet clamps, etc.).

In some embodiments, the fork assembly 120 can include a suspension mechanism. Such a suspension mechanism can include one or more springs to take up some of the shock loading or impact from bumps or other surface irregularities that the wheel 112 encounters. The suspension mechanism can provide for a smoother and more efficient user experience in some cases. Accordingly, using such a suspension mechanism, a length of the fork assembly 120 is dependent on an amount of compression of the spring(s) in the suspension mechanism.

In some embodiments, the fork head member 124 of the fork assembly 120 allows for the pivoting of the fork legs 122*a-b* (and, consequently, the wheel assembly 110) about the longitudinal axis of the fork head member 124 relative to the yoke 130 (and, consequently, relative to the wheelchair 10). In this manner, the user 1 can pivot the wheel assembly 110 to aim the wheel assembly 110 or to change directions of the wheel assembly 110 (i.e., to steer the wheelchair accessory device 100 and the wheelchair 10 to which it is attached). In some embodiments, the extent of the range of such pivoting of the fork legs 122*a-b* is restricted to within end-of-travel limits (e.g., limited to between 5° to 30° in each direction, or between 20° to 45° in each direction, or between 30° to 60° in each direction, without limitation).

In particular embodiments, the fork assembly 120 includes a releasable latch that: (i) in a first state allows the wheel assembly 110 to pivot in relation to the yoke 130 for steering as described above and (ii) in a second state locks the wheel assembly 110 straight ahead and prevents the wheel assembly 110 from pivoting in relation to the yoke 130.

The fork assembly 120 also comprises the fork-to-yoke coupling mechanism 126. The fork-to-yoke coupling mechanism 126 is attached to an upper end portion of the fork head member 124. The fork-to-yoke coupling mechanism 126 is pivotably coupled to the center portion of the yoke 130.

Now referring also to FIG. 3, the fork-to-yoke coupling mechanism 126 configures the fork assembly 120 to allow the wheel assembly 110 to pivot in relation to the yoke 130 and the wheelchair 10 between the deployed operative configuration (as shown in FIGS. 1 and 2) and a retracted stowed configuration (as shown in FIG. 3).

In the retracted stowed configuration, the wheelchair accessory device 100 is out of the way so that the user 1 of the wheelchair 10 can use the wheelchair 10 like a normal wheelchair. Nevertheless, the wheelchair accessory device 100 is still attached to the wheelchair 10 as described above, and it ready to be selectively deployed to the operable configuration (FIGS. 1 and 2).

In the retracted stowed configuration (as depicted in FIG. 3), the wheel 112 is out of contact with the surface (e.g., above the floor, ground, etc.) that is supporting the wheelchair 10.

In the depicted embodiment, the fork-to-yoke coupling mechanism 126 includes a handle 128 that is configured for manually pivoting the fork assembly 120 relative to the yoke 130. That is, to convert the wheelchair accessory device 100 from the deployed configuration to the retracted stowed configuration, the user 1 (or another person) can simply pull up on the handle 128. The reverse is also true. That is, to convert the wheelchair accessory device 100 from the retracted stowed configuration to the deployed configuration, the user 1 (or another person) can simply push down on the handle 128.

In some embodiments, the wheelchair accessory device 100 also includes a ratchet mechanism that operates between the fork-to-yoke coupling mechanism 126 and the center portion of the yoke 130. In such a case, manually pivoting the fork assembly 120 relative to the yoke 130 (e.g., using the handle 128 as described directly above) actuates the ratchet mechanism. Such a ratchet mechanism can make the reconfiguration of the wheelchair accessory device 100 from the deployed configuration to the retracted stowed configuration easier to perform. Also, the ratchet mechanism can latch/detain the fork assembly 120 relative to the yoke 130 so that the wheel 112 stays above the floor surface while in the retracted stowed configuration. In some embodiments, to release the ratchet mechanism the user 1 can simply pull up on the handle 128. Then the wheelchair accessory device 100 can be reconfigured in the other direction (from the retracted stowed configuration to the deployed configuration). Other types of ratchet release mechanisms are also envisioned.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results.

What is claimed is:

1. A wheelchair accessory device for attachment to a wheelchair, the wheelchair accessory device comprising:

a wheel assembly comprising:
- a wheel including a hub;
- a first crank arm affixed to the hub;
- a first pedal pivotably attached to the first crank arm;
- a second crank arm affixed to the hub; and
- a second pedal pivotably attached to the second crank arm;

a yoke comprising:
- a first end portion;
- a second end portion opposite of the first end portion; and
- a center portion between the first and second end portions;

a first clamp device configured to releasably clamp the first end portion of the yoke to a first tube of a wheelchair;

a second clamp device configured to releasably clamp the second end portion of the yoke to a second tube of the wheelchair; and a fork assembly interconnecting the yoke and the wheel assembly, the fork assembly including a fork-to-yoke coupling mechanism pivotably coupled on the center portion of the yoke whereby the wheelchair accessory device is selectively reconfigurable, by manually pivoting the fork assembly relative to the yoke, between: (i) a deployed operative configuration in which the wheel assembly is positioned in front of the wheelchair and the wheel is in contact with a surface on which the wheelchair rests and (ii) a retracted stowed configuration in which the wheel assembly is at least partially under a seat of the wheelchair and the wheel is out of contact with the surface.

2. The wheelchair accessory device of claim 1, wherein the hub is rotatably coupled to the fork assembly.

3. The wheelchair accessory device of claim 1, wherein the fork assembly is adjustable in length.

4. The wheelchair accessory device of claim 1, wherein the fork assembly further comprises a handle configured for manually pivoting the fork assembly relative to the yoke.

5. The wheelchair accessory device of claim 4, further comprising a ratchet mechanism between the fork-to-yoke coupling mechanism and the center portion of the yoke, and wherein manually pivoting the fork assembly relative to the yoke actuates the ratchet mechanism, and wherein the ratchet mechanism is configured to latch and detain the wheel above the surface while the wheelchair accessory device is in the retracted stowed configuration.

6. The wheelchair accessory device of claim 1, wherein the first clamp device releasably clamps the first end portion of the yoke to the first tube of the wheelchair at 90-degrees relative to each other.

7. The wheelchair accessory device of claim 6, wherein the second clamp device releasably clamps the second end portion of the yoke to the second tube of the wheelchair at 90-degrees relative to each other.

8. The wheelchair accessory device of claim 1, wherein the fork assembly comprises:

a first fork leg to which the wheel assembly is rotatably coupled;

a second fork leg to which the wheel assembly is rotatably coupled; and a fork head member with a lower end portion affixed to the first and second fork legs.

9. The wheelchair accessory device of claim 8, wherein the length of the fork head member is incrementally adjustable.

10. The wheelchair accessory device of claim 1, wherein the wheelchair accessory device is configured to operate in an exercise mode in which a user pedals the first and second pedals and first and second crank arms without turning the wheel.

11. The wheelchair accessory device of claim 10, further comprising a clutch mechanism by which the exercise mode can be selectively activated and deactivated.

12. The wheelchair accessory device of claim 11, further comprising a resistance adjustment mechanism by which forces required to pedal the first and second pedals and first and second crank arms are adjustable while in the exercise mode.

* * * * *